United States Patent [19]

Whitaker, Jr.

[11] Patent Number: 4,967,847

[45] Date of Patent: Nov. 6, 1990

[54] METHOD AND APPARATUS FOR CLEANING BALLAST

[75] Inventor: John B. Whitaker, Jr., Wetumpka, Ala.

[73] Assignee: Kershaw Manufacturing Company, Inc., Montgomery, Ala.

[21] Appl. No.: 470,170

[22] Filed: Jan. 25, 1990

[51] Int. Cl.[5] ..... E01B 27/10

[52] U.S. Cl. ..... 171/16; 171/130; 37/104; 37/107; 104/7.3

[58] Field of Search ..... 171/16, 130, 131; 104/7.1, 7.3, 2; 37/104, 105, 106, 107

[56] References Cited

U.S. PATENT DOCUMENTS

| | | | |
|---|---|---|---|
| 865,261 | 9/1907 | Mchaffey | 171/16 |
| 2,609,619 | 9/1952 | Jones | 104/7.1 X |
| 2,664,652 | 1/1954 | Talboys | 37/104 X |
| 2,886,904 | 5/1959 | Kershaw | 37/104 |
| 4,850,123 | 7/1989 | Whitaker, Jr. | 37/104 |

FOREIGN PATENT DOCUMENTS

| | | | |
|---|---|---|---|
| 249298 | 9/1987 | Fed. Rep. of Germany | 171/16 |
| 207401 | 2/1960 | German Democratic Rep. | 104/2 |
| 970010 | 9/1964 | United Kingdom | 37/104 |

*Primary Examiner*—Dennis L. Taylor
*Assistant Examiner*—Jeffrey L. Thompson
*Attorney, Agent, or Firm*—Jennings, Carter, Thompson & Veal

[57] ABSTRACT

An articulated ballast cleaning system utilizes a pair of ballast cleaners each dedicated to cleaning only a portion of the ballast bed of a railroad track, such that one cleans the peripheral ballast while the other cleans the center ballast. Spoil or waste ballast is conveyed forwardly along the apparatus for disposal, while cleaned ballast is conveyed rearwardly for replacement aft of an undercutter device. Fresh ballast may be conveyed forwardly along the apparatus to supplement the cleaned ballast.

10 Claims, 2 Drawing Sheets

METHOD AND APPARATUS FOR CLEANING BALLAST

Field of the Invention

The present invention relates generally to the field of railroad maintenance and particularly to a method and apparatus for reconditioning ballast used as the roadbed for a railroad track. More particularly, the invention relates to reconditioning the ballast at a relatively high rate of speed by separately removing a portion of the ballast which is less susceptible to contamination or deterioration, salvaging reusable ballast from this portion, removing the remainder of the ballast, salvaging reusable ballast from this portion, then combining the salvaged ballast for replacement beneath the track with waste being conveyed along the track for disposal.

Background of the Invention

As is well known the ballast forming the roadbed of a railway track is susceptible to contamination and deterioration caused by the passage of trains over the track. In some areas the ballast must be reconditioned at least annually. There are numerous forms of apparatus which have been developed for this task. Typical apparatus which are used for this type operation include track undercutters to remove the ballast from beneath the tracks, ditcher wheels to remove ballast from areas alongside the tracks and cleaning screens to recover reusable ballast from the ballast removed by the undercutters and ditcher wheels.

It will be appreciated that the rail lines which require the most frequent maintenance are the busiest lines, therefore the time available during which the tracks may be blocked by apparatus reconditioning the ballast is quite limited. Therefore it is imperative that the reconditioning proceed as rapidly as possible. Typical ditcher wheels may remove ballast from alongside the tracks at speeds up to 5,000 feet per hour and typical undercutters may operate at slightly reduced speeds. However when the ballast from the undercutter and ditcher wheels are fed to a cleaning screen, the rate of progress is limited by the capacity of the screen. Typical screen capacity limits the forward rate of travel in such instances to about 1,000 feet per hour. The shortcomings of such machines are well known and are fully discussed in U.S. Pat. No. 4,534,415. U. S. Pat. No. 4,534,415 purports to improve the speed of the operation by providing a further ballast screening installation, mounted on the apparatus frame, which may thus effectively double the capacity of the cleaning system. While such an apparatus seems suitable for its intended purpose, it leaves something to be desired in terms of economy and efficiency in that the apparatus is appreciably more complex than the instant invention.

I have previously addressed this problem in my U.S. Pat. No. 4,705,115, wherein I separated the fouled ballast and cleaned only the portion of the ballast which was most contaminated, to wit, the ballast directly beneath the track. While this was acceptable in certain circumstances, it was not always the best mode for reconditioning the track. Thus there remains a need for an apparatus which will rapidly and completely recondition the ballast.

Summary of the Invention

It is the object of the present invention to provide a method and apparatus for reconditioning the ballast along a railroad track at a substantially higher rate of speed than heretofore possible while cleaning the ballast from one side of the track to the other.

Yet another object of the invention is to provide a unitized apparatus which can clean the ballast as desired and remove waste ballast forwardly along the track for disposal and receive fresh ballast for replenishing the cleaned ballast from rearwardly along the track.

Still another object of the invention is to provide an articulated system which can negotiate relatively small radius curves in the track without increasing the height of the system.

The above objects are advantageously accomplished in my invention by the use of six frame members which are articulated on seven shared carriages or bogies which travel on the railroad track. The frame members support a plurality of work stations which sequentially remove, clean and retain portions of the ballast bed. In essence, the ballast bed is divided into longitudinally extending regions which are separately removed and cleaned by dedicated mechanisms with the cleaned ballast being recombined for reuse beneath the track. To accomplish this, I use a pair of opposed ditcher wheels which remove ballast from adjacent the track to a ballast cleaner supported on one of the articulated frames. A set of tie end cutters are then used to undercut the ends of the sleeper or cross ties and the ballast outwardly of the track is graded. The ballast cleaner discharges the cleaned ballast adjacent the track, while the spoil or waste is conveyed forwardly along the track for disposal. The deposited cleaned ballast is recovered by a second set of ditcher wheels mounted forwardly of an undercutter which removes all of the ballast remaining beneath the track down to a selected depth. This fouled ballast is removed to a second ballast cleaner which discharges a cleaned portion which is recombined with the ballast recovered by the second set of ditcher wheels and deposited beneath the track rearwardly of the undercutter.

Brief Description of the Drawings

Apparatus embodying features of my invention are depicted in the accompanying drawings which form a portion of this invention and wherein.

Description of the Preferred Embodiment

Figure 1:
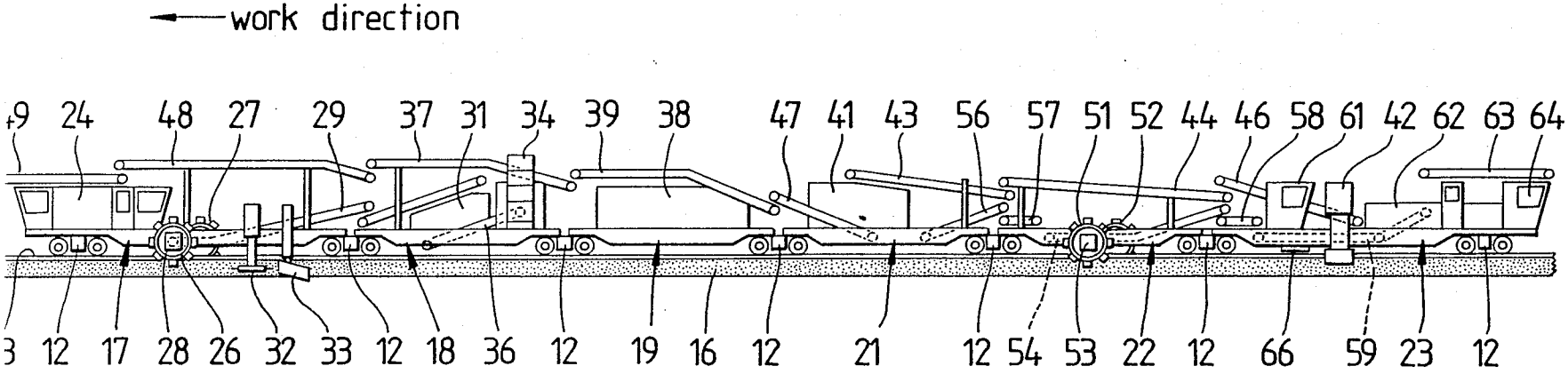
FIG. 1 is a side elevational view of the articulated ballast cleaning system.
Figure 8:
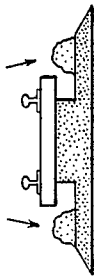
Figure 6:
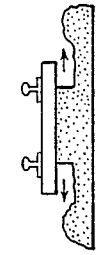
Figure 7:
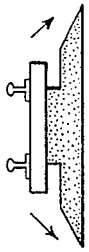
Figure 5:
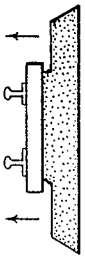
Figure 2:
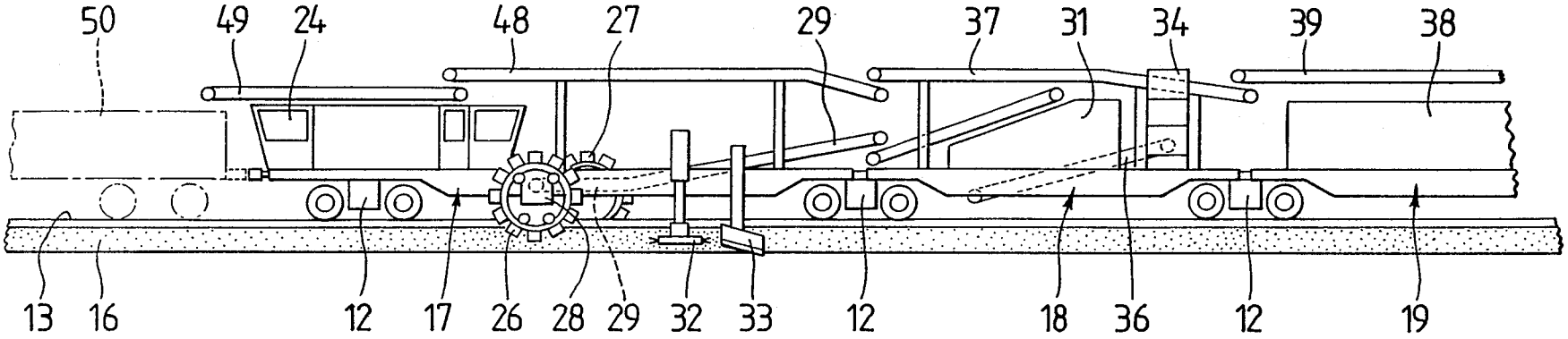
FIG. 2 is a side elevational view of the forward section of the articulated ballast cleaning system dedicated to removing ballast alongside the track.
Figure 3:
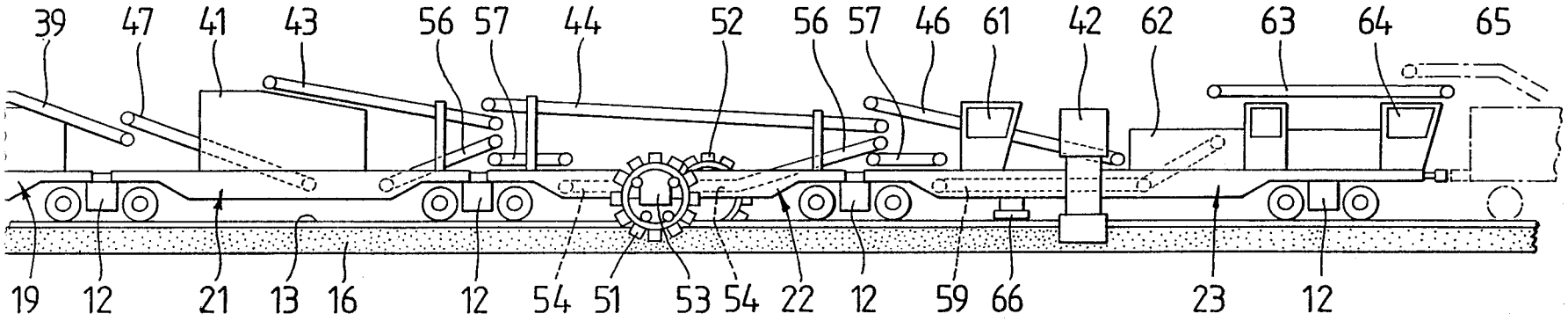
FIG. 3 is a side elevational view of the rearward section of the articulated ballast cleaning system which removes ballast from beneath the track.

Referring to the drawings for a clearer understanding of my invention it will be seen in FIGS. 1–3 that my ballast cleaning apparatus 11 is an articulated vehicle having a plurality of carriages 12 or bogies which engage the rails 13 of a railroad track which include the sleepers 14 or crossties and rails 13 and which is supported on a ballast bed 16. The carriages 12 support six frame members 17–19 and 21–23 with each adjacent frame member sharing a bogie 12 such that the vehicle is articulated at the bogies 12. Forward frame member 17 supports a driver's cabin 24 having conventional control connections thereto which are not shown. Also supported on frame members 17 are a pair of ditcher wheels 26 and 27 which remove fouled ballast from adjacent the ends of the crossties 14 as shown in FIG. 5 to associated cross conveyors 28 (only one of which is shown) which carry the fouled ballast to a center conveyor 29 for transport to a screen cleaner 31 supported on frame member 18. A tie end undercutter 32 such as disclosed in my U.S. Pat. No. 4,850,123, which removes ballast from beneath the ends of the crossties 12, as shown in FIG. 6, is also mounted on carriage 17 along with a blade assembly 33 which grades the ballast outwardly of the track removing only accumulated fouled ballast discharged by the tie end cutter 32 as shown in FIG. 7. The ballast cleaner 31 separates the fouled ballast into a cleaned portion and a spoil or waste portion. The cleaned portion is discharged adjacent the track as shown in FIG. 8 and the waste portion is conveyed to a lifting wheel 34, which is simply a vertical conveyor which lifts the spoil from a discharge conveyor 36 to a spoil conveyor system including elevated conveyor 37 supported on frame 18 above the ballast cleaner 31.

Frame member 19 supports a power module 38 which includes diesel engines generating 2000 hp, hydraulic pumps, reservoirs and fuel tanks, all of which are conventional and are not shown in the interest of clarity. Overlying the power module 38 is a spoil conveyor 39 which has its discharge end positioned above elevated conveyor 37.

Frame member 21 supports a second screen ballast cleaner 41 which cleans fouled ballast removed from beneath the track by an undercutter 42 supported on frame member 23. The fouled ballast is transferred to the ballast cleaner 41 by fouled ballast conveyors 43, 44, and 46 which are elevated conveyors cooperatively supported on frame members 21, 22, and 23 respectively. Spoil or waste ballast is discharged from ballast cleaner 41 onto spoil conveyor 47 for delivery to spoil conveyor 39. It thus may be seen that waste ballast removed from beneath and alongside the track is combined on elevated conveyor 37 and carried forwardly along the track to an elevated conveyor 48 supported on frame 17 and hence to a discharge conveyor 49 overlying the operator's cab 24. The waste ballast is discharged into a hopper car 50 forward of the ballast cleaner apparatus 11.

Figure 9:
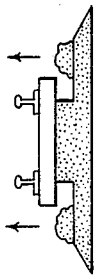

Frame member 22 supports a second pair of ditcher wheels 51 and 52 and their associated cross conveyors 53 (only one of which is shown). The ditcher wheels recover the cleaned ballast deposited by ballast cleaner 31 as indicated in FIG. 9, and the cross conveyor delivers the cleaned ballast to a clean ballast conveyor supported on frame member 22. Thus the undercutter 42 does not have to remove any ballast except that under the center of the track as per FIG. 10 and ballast cleaner 41 has only to clean that portion removed by the undercutter 42. The cleaned ballast from ballast cleaner 41 is transported on the clean ballast conveyor system by intermediate conveyors 56 and 57 to clean ballast conveyor 54. Clean ballast conveyor 54 has a discharge end overlying a receiving conveyor 58 mounted on frame member 23 which delivers the combined cleaned ballast to a discharge conveyor 59 which carries the cleaned ballast past an operator station 61 and the undercutter 42 to a point rearwardly of the undercutter 42. A portion of the cleaned ballast may be deposited beneath the track or sent to a cleaned ballast hopper 62 also on carriage 23. When the cleaned ballast is insufficient to properly reform the ballast bed fresh ballast conveyor 63 delivers fresh ballast from a hopper car 65 located rearwardly of a rear driver's cab 64. Carriage 23 also supports a track lifting attachment 66 which is used in conjunction with the undercutter 42 as is conventionally known.

Figure 12:
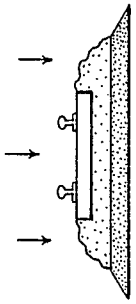
FIGS. 4–12 are sectional views of the track and ballast bed during operation of my apparatus.
Figure 10:
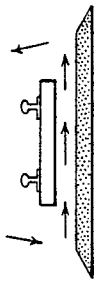
Figure 4:
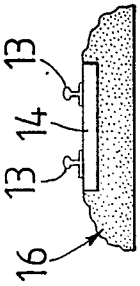
Figure 11:
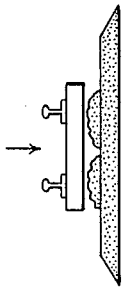

Although the operation of my device should be relatively clear to those familiar with railroad maintenance equipment, FIGS. 4–12 give a pictorial representation of the track and ballast as my apparatus reconditions the ballast. In FIG. 4 the track and ballast are shown in their undisturbed fouled condition. In FIG. 5, the ballast adjacent the ends of the crossties has been removed by ditcher wheels 26 and 27 for cleaning by screen cleaner 31. In FIG. 6, the tie end cutters 32 have removed fouled ballast from beneath the ends of the sleepers 14 to a position outwardly of the tracks. In FIG. 7, blade assemblies 33 have graded the ballast in preparation for the deposit of cleaned ballast by cleaner 31 as in FIG. 8. FIG. 9 illustrates the cleaned ballast which is to be removed by the ditcher wheels 51 and 52. In FIG. 10 the track supported by track lifting apparatus 66 has been undercut by undercutter 42 and in FIG. 11 cleaned ballast from the two screen cleaners 31 and 41 has been deposited rearwardly of the undercutter 42. In FIG. 12, the ballast bed has been reformed to its original condition using a combination of cleaned and fresh ballast.

From the foregoing, it is clear that my device is a clearly superior unitized track cleaning apparatus, however the actual physical characteristics are even more impressive. The entire apparatus, not including hopper cars for spoil or fresh ballast, is 260 feet in length and has a travel turning radius of 250 feet. The unit can remove, clean, and restore the ballast at a depth of 280 mm below the sleepers at a rate of 480 meters per hour. Further no spoil is left along side the track and with a height of 13 feet the apparatus can be used in virtually any locale.

While I have shown my invention in one form, it will be obvious to those skilled in the art that it is not so limited but is susceptible of various changes and modifications without departing from the spirit thereof.

What I claim is:

1. Apparatus for cleaning ballast beneath a railroad track comprising a plurality of spaced apart carriages, each carriage supporting the adjacent ends of a pair of elongated frame members, each carriage being supported on rails of an underlying railroad track, with a plurality of discrete work stations supported on said frame members including means for removing fouled ballast from adjacent the sides of said underlying railroad track; first means for cleaning and separating said removed ballast into a first waste portion and a first cleaned portion; means for removing the outermost portion of the fouled ballast underlying said railroad track to a position adjacent said track; means for grading said fouled ballast adjacent said track; discharge means associated with said first cleaning means for returning said first cleaned portion to a position adjacent said track; drive means for propelling and driving said apparatus; second means for cleaning and separating fouled ballast removed from beneath said track into a second cleaned portion and a second waste portion; means for lifting said first cleaned portion previously discharged adjacent said railroad track; first conveyor means receiving said first and second cleaned portion having a discharge end for depositing cleaned ballast selectively beneath said track or into a cleaned ballast hopper; track lifting means for supporting said track as ballast is removed therebeneath; undercutter means located forwardly of said discharge end for removing fouled ballast from beneath said railroad track operatively connected to transfer said fouled ballast to said second cleaning means; spoil conveyor means receiving said second waste portion for conveying waste ballast forwardly superjacent said drive means, first cleaning means, and excavator means to an associated receptacle; means for elevating said first waste portion from said first cleaning means into said spoil conveyor means; and fresh ballast conveying means for delivering fresh ballast from an associated storage facility to replenish the volume of ballast deposited beneath said track.

2. Apparatus as defined in claim 1 wherein said means for removing said outermost portion and said means for lifting said cleaned portion each comprise a pair of ditcher wheels mounted on either side of an associated frame member and a cross conveyor positioned within each ditcher wheel to receive ballast from said ditcher wheel to convey said ballast to the center of said frame.

3. Apparatus as defined in claim 2 wherein said first and second means for cleaning are vibrating screen cleaners mounted on associated frame members with said first cleaning means receiving fouled ballast from said outermost portion removing means via a conveyor extending along the center of said frame member to receive ballast from said cross conveyors, and with said second cleaning means receiving fouled ballast from said undercutter means via an elevated conveyor overlying a portion of said first conveyor means.

4. Apparatus as defined in claim 1 wherein said first and second means for cleaning are vibrating screen cleaners mounted on associated frame members with said first cleaning means receiving fouled ballast from said outermost portion removing means via a conveyor extending along the center of said frame member to receive ballast from a set of ditcher wheels and associated cross conveyors, and with said second cleaning means receiving fouled ballast from said undercutter means via an elevated conveyor overlying a portion of said first conveyor means.

5. Apparatus for cleaning ballast from beneath a railroad track comprising a plurality of frame members supporting a plurality of work stations and conveying elements with the adjacent ends of each pair of said plurality of frame members being supported on a shared carriage which is supported on the railroad track, one of said work stations including means for removing fouled ballast from adjacent said railroad track, first means for cleaning foulded ballast removed from adjacent said track; undercutter means for removing fouled ballast from beneath said railroad track; second means for cleaning said fould ballast removed from beneath said railroad track; means for combining ballast cleaned by said first and second cleaning means for deposit beneath said track; and spoil conveyor means for conveying waste ballast from said first and second cleaning means forwardly along said railroad track for disposal, wherein said means for combining comprises a discharge member on said first cleaning means for discharging cleaned ballast adjacent said railroad track; means for lifting said discharged ballast onto a combining conveyor means supported on a plurality of said frame members and positioned to receive clean ballast discharged by said second cleaning means.

6. Apparatus as defined in claim 5 further comprising means for removing a portion of said fouled ballast from beneath the outer portion of said railroad track to a position adjacent said railroad track and means for grading said ballast moved outwardly from said railroad track.

7. Apparatus as defined in claim 5 wherein said first and second means for cleaning are vibrating screen cleaners mounted on associated frame members with said first cleaning means receiving fouled ballast from said removing means via a conveyor extending along the center of said frame member associated with said removing means to receive ballast therefrom, and with said second cleaning means receiving fouled ballast from said undercutter means via an elevated conveyor overlying a portion of said first conveyor means.

8. Apparatus as defined in claim 5 wherein said spoil conveyor means comprises a first conveyor receiving waste ballast from said second cleaning means and conveying said ballast forwardly and upwardly to a plurality of elevated conveyors supported on a plurality of said frame members superjacent selected work stations, and means for elevating the waste ballast discharged by said first cleaning means onto said plurality of elevated conveyors.

9. A method for cleaning and reconditioning ballast beneath a railroad track utilizing a plurality of work stations on a plurality of frame members, each pair of which share a common undercarrriage comprising the steps of excavating fouled ballast from adjacent underlying railroad track; separating said fouled ballast into a first cleaned portion and a first waste portion with said first cleaned portion being returned to a position adjacent said track and said first waste portion being removed forwardly along said railroad track for disposal; recovering said first cleaned portion from adjacent said railroad track; removing fouled ballast from beneath said railroad track; separating said fouled ballast from beneath said railroad track into a second cleaned portion and a second waste portion; combining said first and second cleaned portions for discharge beneath said track to replace the fouled ballast removed therefrom; removing said second waste portion forwardly in combination with said first waste portion for disposal; and replenishing said cleaned ballast with fresh ballast transported along said track from a rearwardly located storage area.

10. The method of claim 9 further comprising removing fouled ballast from beneath the outer portion of said track to a position adjacent said track and grading the ballast adjacent said track prior to depositing said first cleaned portion thereon.

* * * * *